US006010108A

United States Patent [19]

Welzen

[11] Patent Number: 6,010,108

[45] Date of Patent: Jan. 4, 2000

[54] ANGULARLY ADJUSTABLE TREE STAND HAVING SPHERICAL BASE SURFACES

[76] Inventor: Joseph A. Welzen, 10220 Third Ave. SE., #1325, Everett, Wash. 98208

[21] Appl. No.: 08/997,387

[22] Filed: Dec. 23, 1997

Related U.S. Application Data

[60] Provisional application No. 60/033,933, Dec. 23, 1996.

[51] Int. Cl.[7] ..... F16M 13/00

[52] U.S. Cl. ..... 248/527; 248/523; 248/520

[58] Field of Search ..... 248/523, 519, 248/527, 520, 346.03, 346.5; 47/40.5

[56] References Cited

U.S. PATENT DOCUMENTS

| | | | |
|---|---|---|---|
| 1,931,376 | 10/1933 | Cosner | 248/527 |
| 3,661,349 | 5/1972 | De Vries | 248/527 |
| 3,872,906 | 3/1975 | Bolanz | 248/523 |
| 4,541,601 | 9/1985 | Corbisello | 248/516 |
| 4,913,395 | 4/1990 | Juhas | 248/527 |
| 5,393,031 | 2/1995 | Leve | 248/527 |
| 5,507,117 | 4/1996 | Kalman et al. | 248/516 |
| 5,707,037 | 1/1998 | Pastrick | 248/516 |

*Primary Examiner*—Leslie A. Braun
*Assistant Examiner*—Gwendolyn Baxter
*Attorney, Agent, or Firm*—Todd N. Hathaway

[57] ABSTRACT

An adjustable stand assembly for mounting a Christmas tree or other plant in the vertical orientation. There is a reservoir member having a spherically-curved, convex lower bearing surface which rests in engagement with a corresponding spherically-curved, concave upper bearing surface on a stationary base member. The trunk of the tree is mounted to the reservoir member and extends through a top opening into the interior thereof. The angle at which the tree extends can be adjusted to vertical by sliding the spherically-curved bearing surface of the reservoir over the spherically-curved bearing surface of the base member. The assembly may also include a separate pot member which is mountable to the trunk of the tree and which rests in the reservoir opening so as to transfer vertical and side loads into the reservoir member and the base member.

14 Claims, 5 Drawing Sheets

ANGULARLY ADJUSTABLE TREE STAND HAVING SPHERICAL BASE SURFACES

This application claims benefits of Provisional application Ser. No. 60/033,933 filed Dec. 23, 1996.

BACKGROUND a. Field of the Invention

The present invention relates generally to tree stands, such as Christmas tree stands, and, more particularly, to a tree stand in which the base is provided with spherical bearing surfaces which permit the tree to be pivoted to a vertical orientation.

b. Background Art

Conventional Christmas tree stands and similar stands which are used to support ornamental plants and/or cuttings commonly take the form of a small, central pot having a plurality (typically four) radially extending legs. The central pot holds a supply of water for the plant, and there is ordinarily a circular collar at the upper end of the pot through which the trunk/stem of the tree or other plant passes so that this extends downwardly into the reservoir. A plurality (e.g., three or four) bolts or screws usually extend inwardly from the perimeter of the collar for adjusting the vertical alignment of the trunk/stem.

Although traditional tree stands have been used for many years, they nevertheless possess numerous drawbacks which have led many users to use them with a sense of disgust every holiday season. Firstly, the central pots of conventional tree stands typically don't hold sufficient water (for example, a large Christmas tree will drink as much as a gallon of water overnight) and therefore have to be frequently refilled or else the tree will go dry, in which case the condition of the tree deteriorates and it quickly changes from a festive decoration to a fire hazard. Moreover, filling the pot can be an exercise in frustration, requiring the owner to kneel down and reach under low-hanging branches with a pitcher or other vessel, and this almost invariably results in a substantial amount of water being spilled on the carpet or floor.

An even more serious problem with traditional tree stands is the difficulty which these present when trying to adjust the tree to a vertical (i.e., straight up-and-down) orientation. The adjustment screws are very hard to reach (unless one is an adolescent who can lie on the floor underneath the branches), and they are also difficult and painful to turn with one's fingers. The actual adjustment is very imprecise and cumbersome, since the butt end of the trunk slides back and forth on the bottom of the pot in a somewhat uncontrollable manner as one. is struggling with tightening and loosening the screws. Moreover, since the person doing the adjustment can't see the actual alignment of the tree, he must rely on instructions (often ambiguous) shouted at him by an observer (typically one's spouse).

Finally, once the tree has been set up, this cannot be rotated about its vertical axis without the legs digging into the carpet or scratching the floor, which makes it very difficult to turn the tree so that it presents its best side to viewers, and also makes it very difficult to string lights and hang ornaments on the side of the tree which faces a wall or other obstruction without having to exercise a high degree of dexterity and physical balance.

On the whole, then, the deficiencies which are inherent in traditional tree stands often render the occasion of setting up a Christmas tree a frustrating (and sometimes infuriating) exercise, instead of this being a joyous holiday event.

Accordingly, there exists a need for a tree stand which can be filled initially with sufficient water to meet the needs of the tree/plant for an extended period, rather than having to be filled every couple of days during the holiday season. Furthermore, there exists a need for a tree stand which permits quick and convenient angular adjustment of the tree to a vertical orientation. Still further, there is a need for a such a stand in which the actual user is able to observe the vertical alignment of the tree while making the adjustments, rather than relying on the observations of a second person. Still further, there exists a need for such a stand which enables the tree/plant to be rotated about the vertical axis once it has been set up, so as to permit the best side to presented to view and also to facilitate placement of lights, tinsel, and other ornaments on a side of the tree to which access might otherwise be blocked or obstructed.

SUMMARY OF THE INVENTION

The present invention has solved the problems cited above, and is an adjustable stand assembly for mounting a tree in a vertical orientation. Broadly, the stand assembly comprises: (a) a stationary base member having a spherically-curved concave upper bearing surface, and (b) a pivoting holder member which is mountable to a trunk of a tree, the holder member having a spherically-curved, convex lower bearing surface which corresponds to and rests in engagement with the spherically-curved upper bearing surface of the base member, so that an angle at which the trunk extends from the holder member is selectively adjustable by sliding the lower bearing surface of the holder member over the upper bearing surface of the base member.

In a preferred embodiment, the holder member may comprise: (a) a reservoir member having the spherically-curved convex bearing surface at a lower end thereof and an opening at an upper end thereof, and (b) means for mounting a trunk of a tree in the opening of the reservoir member so that the trunk extends downwardly therethrough into a water-containing interior of the reservoir member.

The means for mounting a trunk of a tree in the opening of the reservoir member may comprise a pot member which is mountable to a trunk of a tree and which is configured to set within and engage the opening of the reservoir member, the pot member comprising: (a) a base portion, (b) an encircling wall portion which extends upwardly from the base portion and defines an interior cavity for receiving a lower end of the trunk of the tree, (c) a rim portion which extends around an upper edge of the wall portion, and (d) means for detachably mounting the trunk to the pot member.

The means for detachably mounting the trunk of a tree to the pot member may comprise a plurality of elongate fastener members mounted to the rim portion of the pot member and extending radially inwardly therefrom so as to engage the trunk of the tree. The pot member may further comprise a vertically extending spike member which is mounted in the base portion of the pot member and points upwardly therefrom so as to penetrate and engage a butt end of a tree trunk which is received in the pot member. The base portion of the pot member may extend downwardly into the reservoir member so as to rest in weight-bearing engagement with a bottom wall of the reservoir member, so as to direct vertical loads from the pot member to the bearing surfaces therethrough.

The assembly may further comprise a pliable sheet member which extends between the upper and lower bearing surfaces in engagement therewith so as to facilitate selective movement of the upper bearing surface over the lower bearing surface, and the pliable sheet member may include an edge portion which extends outwardly from between the bearing surfaces so as to provide a hand grip for pulling on the sheet member while moving the upper bearing surface over the lower bearing surface. The pliable sheet member may comprise a sheet of pliable woven cloth.

The base member and reservoir member of the assembly may be formed of blow-molded plastic, and the pot member may be formed of injection molded plastic.

DETAILED DESCRIPTION

Figure 1:
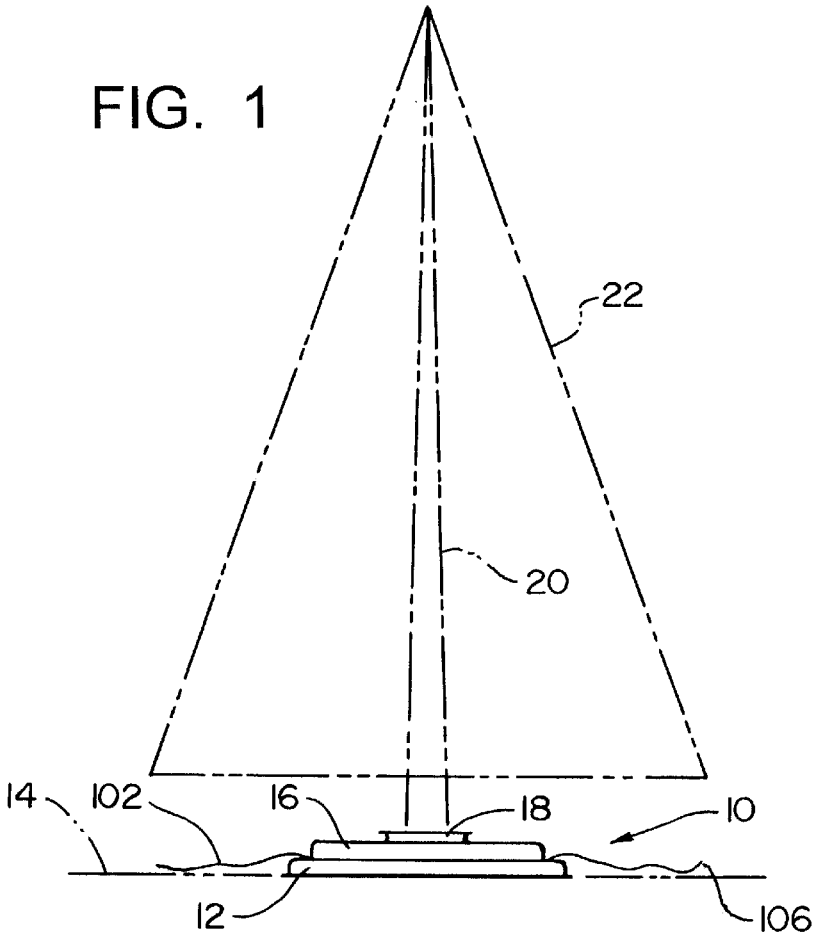
FIG. 1 is an elevational view of the tree stand of the present invention with an exemplary Christmas tree mounted therein, as indicated somewhat schematically by the broken-line image.
Figure 2:
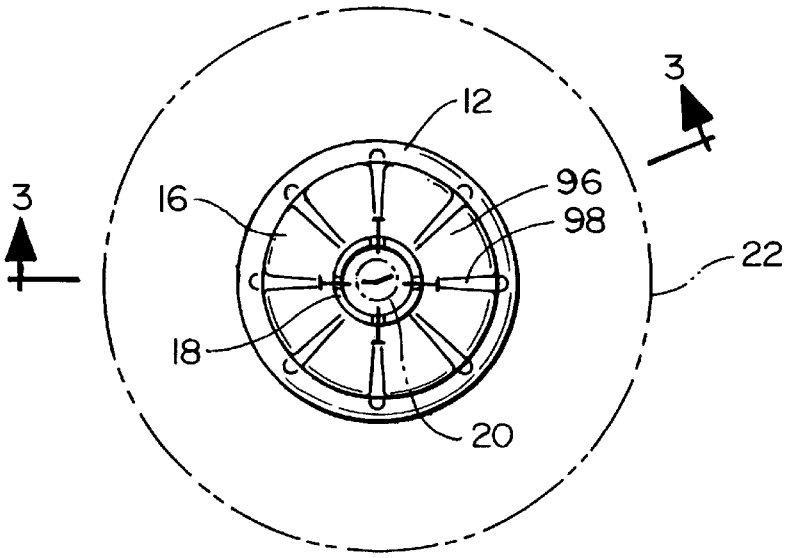
FIG. 2 is a top plan view of the stand and tree of FIG. 1.

As can be seen in FIG. 1, the tree stand 10 in accordance with the present invention includes a base member 12 which rests flat on a floor 14 or other support surface, a reservoir member 16, and a pot member 18 in which the trunk 20 of the tree 22 is received. The present invention will be described herein with reference to its use with a Christmas tree, which is perhaps the most common application, however it will be understood that the term "tree" as it is used in this description and the appended claims includes not only Christmas trees but also other types of trees and plants, both cut and uncut; for example, in some embodiments the present invention may be used as a stand for a potted plant with or without soil in the pot member of the assembly.

Figure 3:
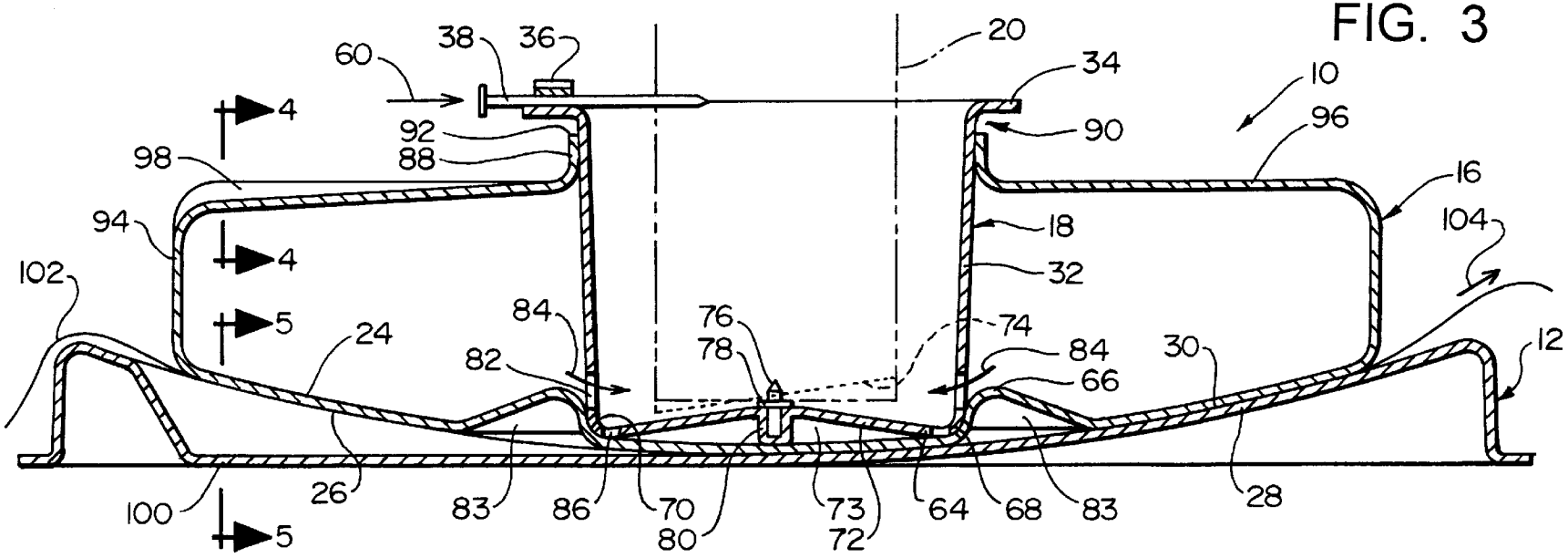
FIG. 3 is an elevational view of a cross-section taken along line 3—3 in FIG. 2, showing the manner in which the trunk of the tree is mounted in the stand assembly, and also showing the spherical engagement surfaces in the base of the stand which permit convenient vertical alignment of the tree.
Figure 5:
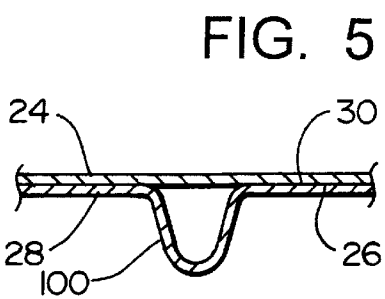
FIG. 5 is a partial, cross-sectional view taken along line 5—5 in FIG. 3, showing the configuration of one of the strengthening ribs formed in the spherically-curved surface of the base member of the stand assembly.
Figure 4:
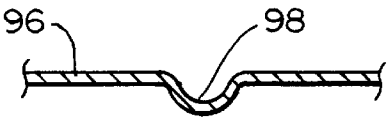
FIG. 4 is a partial, cross-sectional view taken along line 4—4 in FIG. 3, showing the configuration of one of the strengthening ribs in the upper surface of the reservoir of the stand assembly.

As can be seen in FIG. 3, the bottom wall 24 of the reservoir member 16 forms spherically curved convex bearing surface 26, while the top wall 28 of the base member 12 forms a corresponding, spherically-curved concave bearing surface 30. As it will be described in great detail below, the spherical bearing which thus is formed by the engagement of the two surfaces 26, 30 enables the tree to be tilted in all directions by a person while standing, and also enables the tree to be twisted or rotated about the vertical axis with ease.

Figure 6:
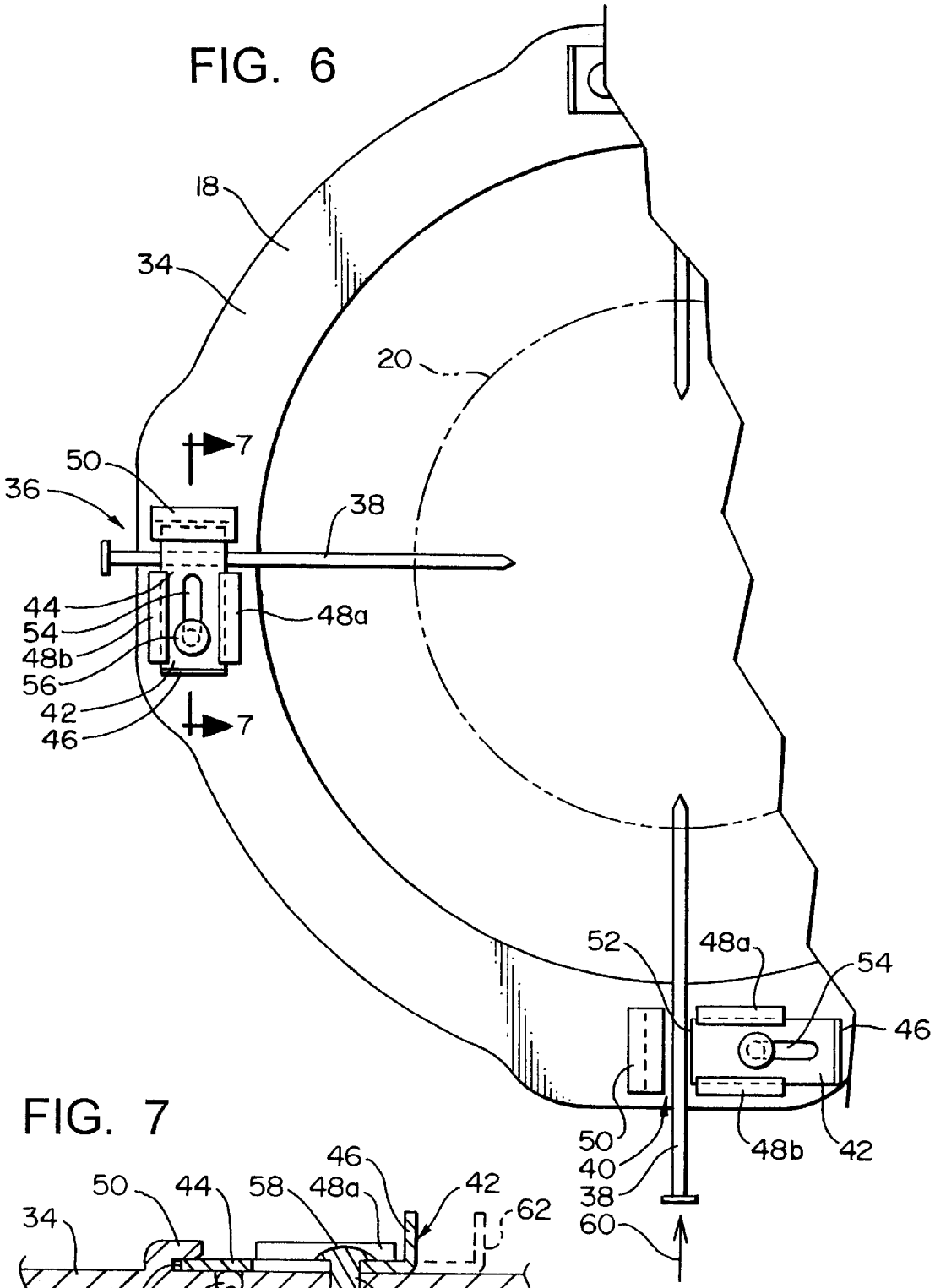
FIG. 6 is a partial, plan view of the tree stand assembly of FIGS. 1–3, showing the manner in which nails driven into the trunk of the tree are held firmly to the pot member of the assembly by a plurality of clip members which are arranged around the upper edge thereof.

As can be seen in FIG. 3 and also in FIG. 6, the pot member 18 preferably has a cylindrical wall portion 32 with a tapered slope for ease of manufacture by injection molding. The pot member may be formed of any suitable material, with a tough, tear-resistant, rigid-type plastic such as high density polyethylene (HDPE) being eminently suitable for this purpose. The pot member is preferably formed with a radially-extending upper rim or flange portion 34 which provides the unit with added rigidity, and also has the ability to react horizontal loads which are imposed by the nails or other fasteners which transmit tree-tipping moments.

Accordingly, the upper flange 34 of the pot member provides a mounting area for one or more engagement members which serve to fasten the pot member to the tree trunk 20. As can be seen in FIGS. 3 and 6, the fastener means may suitably be a plurality (e.g., four) of mounting clip assemblies 36 which engage the shanks of nails 38 or similar fasteners which have been driven into the trunk 20 of the tree. As will be described in greater detail below, other fastening means such as screws and bolts may be used in place of the nails; while these may bear a superficial resemblance to the adjustment screws of traditional tree stands such as those described above, it will be understood that in the present invention the nails or other fasteners simply mount the pot member securely to the trunk of the tree and do not themselves serve an adjustment function.

The nails 38 may be conventional nails (as shown) or may be headless nails or other similar spikes/fasteners, and may be formed of a corrosion-resistant steel or steel coated with a corrosion-resistant surface material such as cadmium, zinc, silver, or nickel plating, for example. A 20D smooth box nail 4" long is eminently suitable for use in the embodiment of the invention which is shown in FIGS. 1–6.

As can be seen in FIG. 6, each of the clip assemblies 36 in the embodiment which is illustrated includes a radially extending nail slot 40 for receiving the shank of the nail 38, and a clip member 42 which slides over this so as to securely retain the nail in the slot. The clip both holds the nail firmly while it is being driven into the tree trunk 20, also keeps the nail from lifting straight up and out at the slot, thereby keeping the pot firmly attached to the tree during placement in and removal from the stand.

Figure 7:
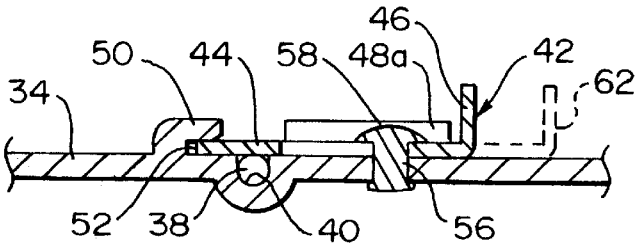
FIG. 7 is sa partial, cross-sectional view taken along line 7—7 in FIG. 6, showing one of the clip members and the manner in which this holds the shank of the nail in engagement with the upper end of the pot member of the stand assembly.

As can be seen, the clip may be suitably formed as a flat, angle member made of a rigid, durable material such as aluminum, stainless steel, rigid plastic, or corrosion resistant or plated/coated steel, for example. In the embodiment which is illustrated, each clip member has a flat, horizontal plate portion 44 (see FIG. 7) which extends over the shank of the nail in slot 40, and an upwardly angled end tab portion 46 which is configured to be grasped between the operator's fingers. The side edges of the plate portion of the clip member are received in corresponding channels formed in raised guide members 48*a*, 48*b*, and a third guide member 50 forms a transverse groove which receives the end 52 of the plate portion of the clip member and prevents the clip from being bent/rotated by loads on the nail. The raised guide members are mounted to the upper surface of the flange portion 34 of the pot member, by being molded integrally therewith or by being attached with adhesive, for example.

The plate portion of each clip member in the embodiment which is illustrated also includes a longitudinally extending slot opening 54. A rivet 56 extends through the slot opening and a corresponding hole and the rim portion of the pot beneath this, so that the clip member is free to slide back and forth in the guide channels while the head 58 of the rivet prevents the clip from being withdrawn completely and lost.

Accordingly, using the end tabs 46, the operator can slide each of the clip members to a closed position in which the plate portion of the clip extends over the nail slot 40, so as to permit the nails to be passed therethrough and driven into the trunk, as indicated by arrow 60 and FIG. 6. In cases where the wood of the trunk is very hard, the nail slots 40 may also be used as guides for drilling holes in the trunk to ease the installation of the nails or other fasteners. Then, to remove the tree, the operator simply slides the clip members back to an open position, as indicated by the broken line image 62 to the right in FIG. 7, so as to release the nails from the slots and allow the tree to be pulled vertically out of the pot member.

Although the specific embodiment of clip assembly which has been described above provides several advantages, especially in terms of convenience and durability, it will be understood that other forms of clip assemblies may be employed in the present invention. For example, the slot 54 and regaining rivet 56 may be deleted in some embodiments in the interest of economy. Furthermore, a long lanyard (not shown) may be attached to the outer end of each clip member (e.g., in the area of tab portion 46) to secure the clip to the pot member in those embodiments where the clip member lacks the slot/rivet arrangement, so as to retain the clip member to the pot and prevent its loss; such a lanyard may suitably be formed from a tough plastic, such as HDPE, in the form of a heavy thread having T-shaped securing pieces at its ends which can be threaded through holes in the clip and pot rim. In some embodiments, the lanyard may also be sized long enough to permit the clip to be moved to the open position by simply pulling on thread.

As can be seen with further reference to FIG. 3, the bottom outer edge of the pot member 18 forms a downwardly protruding base ring 64 which fits closely inside an upwardly projecting annular shoulder 66 formed in the bottom wall 24 of the reservoir member. Preferably, the outer corners 68 of the circular base ring are rounded/radiused to match a corresponding annular inside corner 70 at the base of shoulder 66, so as to form a firm, stable load-bearing interfit between the two members.

The circular bottom wall 72 of the pot member, inside of base ring 64, is preferably dome-shaped or pyramidal, with its highest point being at the center, so as to permit the butt end of a tree trunk which is not cut straight across (i.e., a trunk which is cut at an angle) to extend fully to the bottom of the pot member, as indicated by dotted line image 74 in FIG. 3. A spike member 76 is mounted at the apex of the domed bottom wall 72 (so that the spike will penetrate the butt end of the trunk when the tree is set down on this), for resisting side loads at the bottom of the trunk.

The spike member may be made of any suitable material, such as corrosion resistant or plated/coated steel, for example. A cylindrical receptacle formed in the bottom wall 72 of the pot member holds the spike member, and the spike is preferably provided with barbs which point upwardly so as to prevent it from being pulled out of the receptacle. Also, the spike member preferably has an annular ring portion 78 which rests atop the domed bottom wall of the pot member so as to distribute the tree load thereto. The domed bottom wall distributes the load of the tree outwardly and downwardly to the base ring 64, for enhanced stability and so as to eliminate any rocking, and the load is then transferred from the base ring to base member 12 through wall 24. A plurality of downwardly-extending, radial fins 73 can also be provided on the underside of the domed bottom wall 72 to provide this with greater strength, and also to form a somewhat flat bottom on the pot member which can be struck against the ground when seating the tree on the spike member.

A plurality (e.g., four) of spaced-apart fill holes 82 are formed in the lower portion of the cylindrical, tapered wall 32 of the pot member 18, so as to be located adjacent the corner 68 of the base ring. These allow water to flow inwardly from the surrounding reservoir, as indicated by arrows 84 in FIG. 3, so that this fills the pot at the time that the tree is introduced into the stand and continues to fill the bowl as the tree drinks the water. Several (e.g., four) depressions 83 having a suitable width (1 inch, for example) are formed through the shoulder 66 at spaced apart locations so as to permit water to flow into the pot approximately the level with the butt end of the tree trunk, thereby achieving maximum utilization of the available water. Several (e.g., four) spaced apart drain holes 86, in turn, allow the water to drain back out of the pot member when the pot and tree are lifted from the reservoir member for disposal.

As can be seen in FIG. 3, the cylindrical wall 32 of the pot member 18 fits closely within the upwardly extending cylindrical neck portion 88 of the reservoir member 16. The extended neck of the reservoir member thus engages the outer surface of the upper part of the pot member so as to react tipping loads placed upon it by it by the tree, acting through bowl member 18. It will be noted, however, that the flange portion 34 of the pot member is positioned a spaced distance 90 above the upper edge 92 of the reservoir neck, so that all vertical loads are directed through the base ring 64 of the pot member, at a very short height above the floor surface 14; this has the advantage of eliminating any cantilever/tipping moments which might otherwise develop if the loads were to be borne at the upper edge 92 of neck 88.

The reservoir member 16 is itself preferably bowl-shaped, with a generally cylindrical outer wall 94 which extends upwardly from the spherically-curved bottom wall 24, and a generally circular top wall 96 which extends inwardly from the outer wall to the upwardly extending neck portion 88. The reservoir thus forms a semi-enclosed container which is able to hold a comparatively large supply of water; for example, in the embodiment which is illustrated, the reservoir may be configured to hold three or more gallons, which is sufficient to supply water to an average size tree for several days.

The reservoir member may be formed of any suitable rigid, tear-resistant, waterproof material, such as blow-molded HDPE or other suitable plastic material. When constructed of plastic, the upper wall 96 of the reservoir member preferably includes several (e.g., eight) radially extending support/reinforcement ribs or "pillows" 98 (see FIG. 4), which add rigidity to the upper wall and thus permit this to more effectively resist compression loads imposed by tree tipping forces.

The spherically convex bottom surface 26 of the reservoir member, in turn, enables the reservoir to be positioned anywhere on the matching, spherically concave upper surface 30 of the base member, which in turn enables the user to tilt the tree as necessary to achieve an upright orientation. As with the top wall of the reservoir member, the top wall 28 of the base member includes a plurality of radial, downwardly projecting rib portions 100 (see FIG. 5) which provide this with additional strength and rigidity.

A slider cloth 102 is preferably positioned between the spherical bearing surfaces 26, 30, and this may be formed of any suitable pliable woven or non-woven sheet material, including cotton, silk, rayon, nylon, or polyester cloth, to give just a few examples. The slider cloth can have any suitable shape, such as round, square, or triangular, for example. Preferably, the slider cloth 102 is sized large enough that its outer edge 106 (see FIG. 1) can be grasped without having to reach further under the bottom limbs of the tree than is convenient, and moreover the slider cloth may be sized large enough to serve the dual function of acting as a drop cloth for collecting needles beneath the tree.

To help position the tree in the upright orientation, the user can grasp the edge of the slider cloth and pull on this, as indicated by arrow 104 in FIG. 3, allowing the reservoir member to slide easily over the base member. The material for the slider cloth is preferably chosen to have a coefficient of friction which is low enough to allow it to slide more or less freely over the spherical bearing surfaces when being pulled by the user, but which is high enough to keep the tree/reservoir from sliding back after the user has positioned it in a selected orientation.

Suitable dimensions for a stand assembly in accordance with the embodiment of the invention which has been described above, and which is generally suitable for use with common sizes of residential Christmas trees, are as follows:

| Reservoir Member | 20" diameter |
|---|---|
| Base Member | 24" diameter |
| Mating Surfaces | 36" spherical rad. |
| Pot Member | 6.5" diameter |
| Overall Assembly Height | 6" |
| Reservoir Member Capacity | 3 gallons |
| Base/Reservoir Material | blow molded HDPE |

FIGS. 8–11 illustrate the sequential steps in the use of the stand of the present invention to erect an exemplary Christmas tree.

Figure 8:
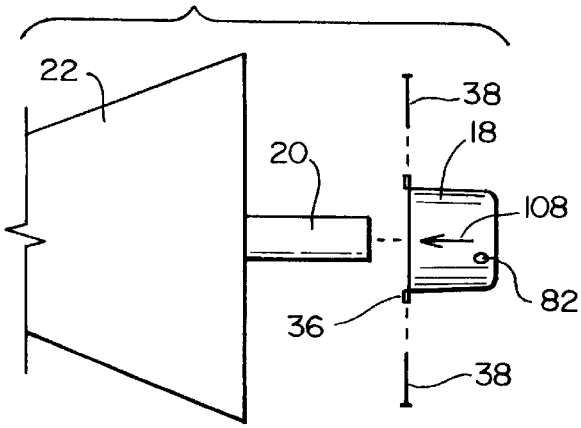
FIG. 8 is the first in a series of elevational views illustrating the sequential steps in the use of the stand of the present invention, this being a view showing the manner in which the pot portion of the assembly is first mounted to the trunk of the tree.

First, as is shown in FIG. 8, the four retaining clips are slid into their respective slots on the pot rim, providing guides for the nails. The pot member 18 is then slid onto the cut end of the trunk, as indicated by arrow 108 in FIG. 8, and the tree is set upright with the pot resting on a flat surface, so that the bottom of the trunk is pushed down onto the spike member in order that this will be held securely in place; as was noted above, the dome shaped bottom of the pot member allows the trunk to fit into the pot and be penetrated by the spike, even if the tree was not cut off straight.

The nails are then pounded into the trunk so as to secure the tree to the pot member in the stable manner. In the case of a commercial tree lot operation, the nails may be pounded in by workers at the tree lot, and the buyer has only to select the tree and take it home with the pot member already attached.

Figure 9:
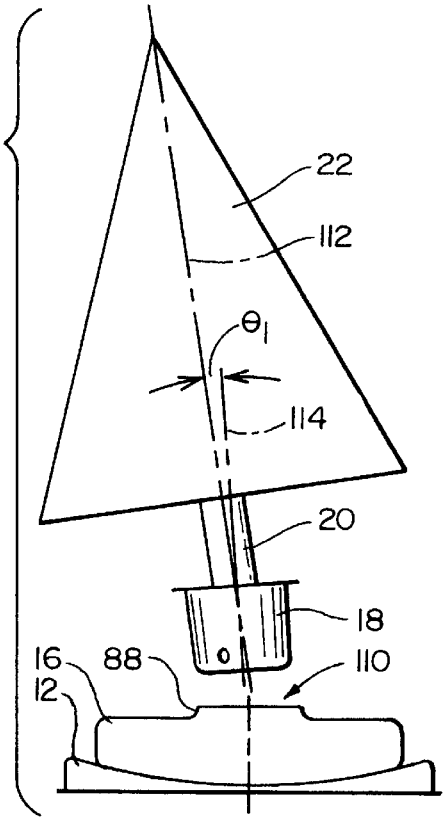
FIG. 9 is the second in the sequential series of views, this showing the manner in which the pot and the trunk of the tree are set into the reservoir portion of the assembly.

In the dwelling, as is shown in FIG. 9, the base and reservoir members 12, 16 are positioned in the desired location, and the reservoir is filled by pouring water through the wide, round mouth 110 which is defined by neck portion 88, with care being taken to allow for the volume of the pot and trunk without overfilling the reservoir (although if spillage does occur, this will be captured by the protruding lip of the base member without running onto the underlying carpet/floor surface). The tree 22 with the pot member 18 attached is then slid into the reservoir member 16 through the mouth opening, until the base ring 64 of the pot member rests on the bottom wall of the reservoir as was described above with reference to FIG. 3.

Figure 10:
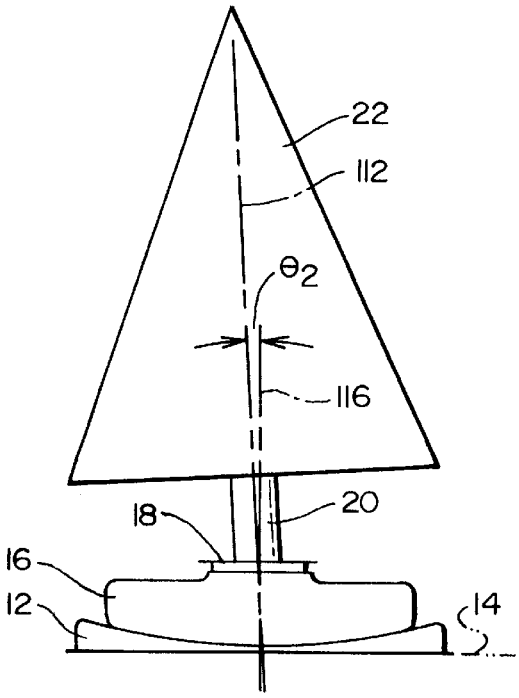
FIG. 10 is the next in the sequential series of views, this showing the tree and stand assembly in a first angular orientation in which the trunk of the tree extends at an angle which is offset from vertical.
Figure 11:
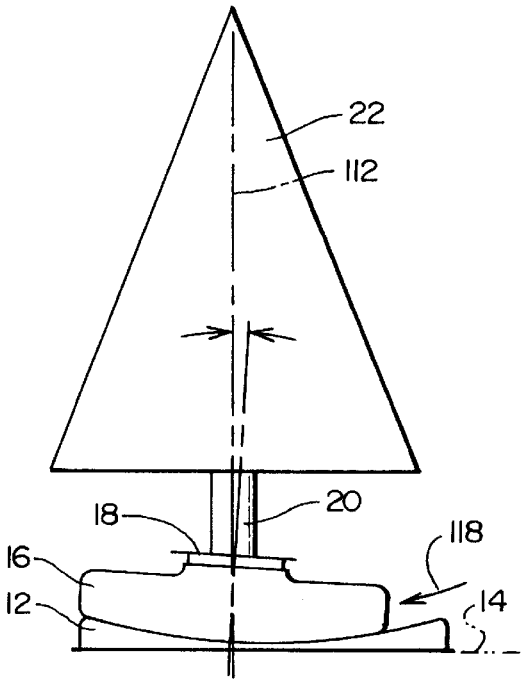
FIG. 11 is the last in the sequential series of views, this showing the manner in which the trunk of the tree is adjusted so as to be aligned in a vertical direction by sliding the convex, spherically-curved surface on the bottom of the reservoir along the concave, spherically-curved surface on the top of the base of the assembly.

As can be seen in FIGS. 9 and 10, when the tree 22 has been installed in the pot member, the approximate vertical axis 112 of the tree will normally be offset from the vertical axis 114 of the pot member 18 by an angle $\theta_1$, due to the natural irregularities of the tree, the angle at which it has been cut, off-center installation of the pot, and so on, and so the tree will normally extend at an angle $\theta_2$ to a perpendicular 116 from the floor when the reservoir has been placed on the base member. However, the spherical bearing surfaces permit the angle of the tree to be adjusted quickly and easily to a perpendicular (or at least visually optimal) orientation, by sliding the reservoir member on the base member as indicated by arrow 118 in FIG. 11. Any minor adjustments to straighten the tree can be made by simply pulling on the appropriate edge of the slider cloth, and the spherical surfaces permit virtually infinite changes in angle. Also, the tree can be rotated very easily on the spherical bearing surfaces so as to show its best side, and this also enables the user to hang lights and ornaments on the "back side" of the tree and then rotate this into its final position, eliminating the difficulty of trying to hang lights/ornaments on the side of the tree where access would otherwise be restricted or blocked by a wall or other obstruction.

When removing the tree for disposal, the tree is lifted from the reservoir member with the pot attached, drip-dried, and taken out to be discarded; as was noted above, the drain holes permit water to drain from the pot member back into the reservoir as the tree and pot are withdrawn. The reservoir member is then picked up and dumped out (e.g., outside or into a toilet, tub, sink, etc.).

The pot member is removed from the tree by pulling the retaining clips to their open position and pulling the pot member off of the trunk. The nails may be removed and saved for future use, using pliers or a hammer for example, or the tree can be discarded with the nails left in the trunk, in which case the nails can be bent over the pulled from the trunk prior to chipping the tree, if desired. The remaining components, i.e., the pot member, reservoir member, base member, and slider cloth are then stored until next use.

Figure 12:
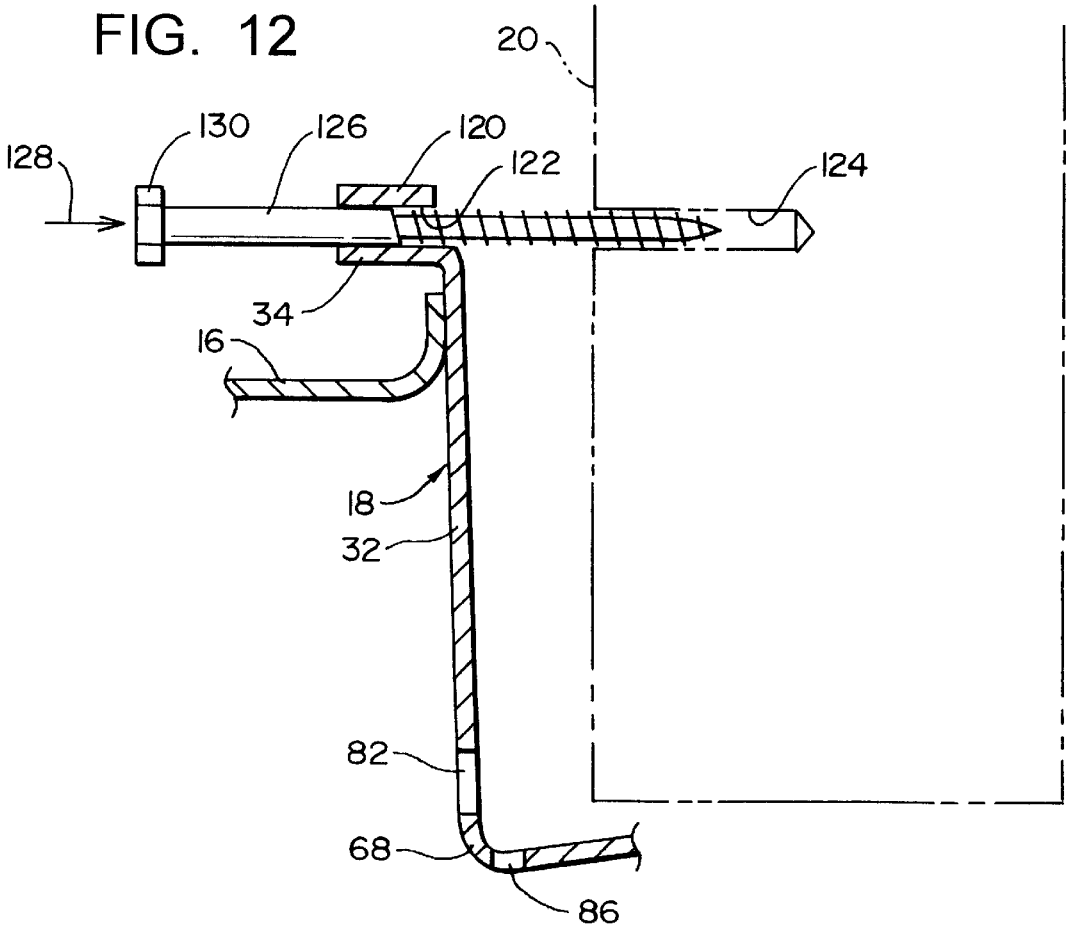
FIG. 12 is a partial, cross-sectional view, corresponding to the upper left portion of FIG. 3, showing a second embodiment of the present invention in which the trunk of the tree is held in the upper end of the stand assembly by screws which are received in corresponding holes which have been drilled in the trunk, this embodiment being particularly suited to use with larger trees.
Figure 13:
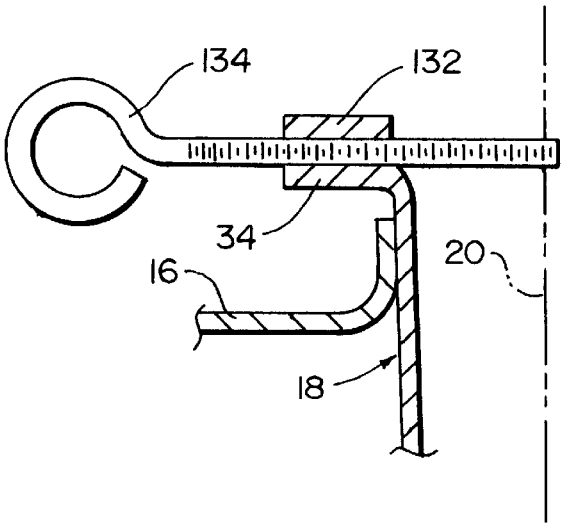
FIG. 13 is a partial, cross-sectional view similar to FIG. 12, showing another embodiment of the present invention, in which the trunk is held in the upper end of the assembly by bolts which pass through corresponding threaded sleeves on the pot member of the assembly.

FIGS. 12 and 13 illustrate embodiments of the present invention in which fasteners are used to secure the trunk of the tree to the pot member without the use of retaining clips. These embodiments, particularly that shown in FIG. 12, may be especially suited to use with larger sizes of trees, and may also provide certain advantages over the above-described embodiment in terms of economy of manufacture. In FIG. 12, for example, a plurality of sleeves 120 are mounted at spaced-apart locations about the upper flange portion 34 of the pot member 18, so as to define bores 122 which are disposed radially towards the center of the pot member. Using the bores 122 as guides after the trunk 20 has been placed in the pot member, the operator drills a plurality of holes 124 into the trunk 20 and then drives a screw 126 (e.g., a ⅜" diameter lag screw or the like) or bolt, nail, spike, or other elongate fastener through each bore and into the associated hole 124, in the direction indicated by arrow 128. The fasteners thus secure the tree firmly to the pot member in a manner similar to the nails 38 described above, and can be withdrawn when ready to dispose of the tree, as by pulling on the head 130 of the lag bolt which is shown in FIG. 12, for example.

FIG. 13, in turn, shows an embodiment of the present invention in which the mechanism for securing the pot member to the tree trunk is somewhat similar to that shown in FIG. 12, except that in this case the sleeves 132 on the flange portion 34 are internally threaded, and these receive the shafts of threaded eye bolts 134 or similar members which extend radially inwardly to press against and engage trunk 20. The ring-shaped heads of the eye bolts (or corresponding structures on other type of bolts) permit the user to screw these inwardly until the trunk is held firmly in place; as was noted above, this arrangement bears a superficial resemblance to the bolts which are used in conventional tree stands, but it will be understood that in the present invention the primary purpose of the bolts is to simply engage and hold the tree trunk, rather than to adjust its angular orientation.

It is to be recognized that various alterations, modifications, and/or additions may be introduced into the constructions and arrangements of parts described above without departing from the spirit or ambit of the present invention as defined by the appended claims.

What is claimed is:

1. An adjustable stand assembly for mounting a tree in a vertical orientation, said stand assembly comprising:

a stationary base member having a generally spherically-curved, downwardly-concave upper bearing surface; and a pivoting holder member which is mountable to a trunk of said tree, said holder member having generally spherically-curved, downwardly-convex lower bearing surface which corresponds to and rests in sliding engagement with said downwardly-concave upper bearing surface of said base member, said holder member forming a reservoir having an opening at an upper end thereof and means for mounting said trunk of said tree in said opening so that said trunk is adapted to extend downwardly therethrough into a water-containing interior of said reservoir; and a pliable sheet member which extends between said upper and lower bearing surfaces in engagement therewith so as to facilitate selective movement of said upper bearing surface over said lower bearing surface;

so that an angular orientation of said trunk is selectively adjustable by sliding said downwardly-convex lower bearing surface of said holder member over said downwardly-concave upper bearing surface of said base member.

2. The stand assembly of claim 1, wherein said pliable sheet member further comprises an edge portion which extends outwardly from between said bearing surfaces so as to provide a hand grip for pulling on said sheet member while moving said upper bearing surface over said lower bearing surface.

3. The stand assembly of claim 2, wherein said pliable sheet member comprises a sheet of pliable woven cloth.

4. An adjustable stand assembly for mounting a tree in a vertical orientation, said stand assembly comprising:

a stationary base member having spherically-curved, downwardly-concave upper bearing surface;

a pivoting holder member which is mountable to a trunk of said tree, said holder member having generally spherically-curved, downwardly-convex lower bearing surface which corresponds to and rests in sliding engagement with said downwardly-concave upper bearing surface of said base member; and a pliable sheet member which extends between said upper and lower bearing surface in engagement therewith so as to facilitate selective movement of said upper bearing surface over said lower bearing surface;

so that an angular orientation of said trunk is selectively adjustable by sliding said downwardly-convex lower bearing surface of said holder member over said downwardly-concave upper bearing surface of said base member.

5. The stand assembly of claim 4, wherein said pliable sheet member further comprises an edge portion which extends outwardly from between said bearing surfaces so as to provide a hand grip for pulling on said sheet member while moving said upper bearing surface over said lower bearing surface.

6. The stand assembly of claim 5, wherein said pliable sheet member comprises a sheet of pliable woven cloth.

7. The adjustable stand assembly of claim 4, wherein said holder member forms a reservoir having an opening at an upper end thereof and means for mounting said trunk of said tree in said opening so that said trunk extends downwardly therethrough into a water-containing interior of said reservoir.

8. The adjustable stand assembly of claim 7, wherein said means for mounting said trunk of said tree in said opening comprises:

a pot member which is mountable to said trunk of said tree and which is configured to fit within and engage said opening, said pot member comprising:

a base portion;

an encircling wall portion which extends upwardly from said base portion and defines an interior cavity for receiving a lower end of said trunk of said tree;

a rim portion which extends around an upper edge of said wall portion; and means for detachably mounting said trunk to said pot member.

9. The adjustable stand of claim 8, wherein said pot member further comprises:

at least one opening formed through said wall portion so as to permit water to flow from said interior of said reservoir into said interior cavity of said pot member.

10. The adjustable stand assembly of claim 8, wherein said means for detachably mounting said trunk of said tree to said pot member comprises:

a plurality of elongate fastener members mounted to said rim portion of said pot member and extending radially inwardly therefrom so as to engage said trunk of said tree.

11. The adjustable stand assembly of claim 10, wherein said plurality of elongate fastener members comprises:

a plurality of nail members having pointed inner ends for being driven into said trunk of said tree.

12. The adjustable stand assembly of claim 11, wherein said pot member further comprises:

a plurality of clamp assemblies mounted to said rim portion of said pot member for detachably retaining said nail members thereto.

13. The adjustable stand assembly of claim 10, wherein said pot member further comprises:

a spike member which is mounted in said base portion of said pot member and points upward therefrom so as to penetrate and engage a butt end of a tree trunk which is receivable in said pot member.

14. The adjustable stand of claim 13, wherein said base portion of said pot member extends downwardly into said reservoir so as to rest in weight-bearing engagement with a bottom wall of said reservoir so as to direct vertical loads from said pot member to said bearing surfaces therethrough.

* * * * *